US005449072A

United States Patent [19]

Braun et al.

[11] Patent Number: 5,449,072

[45] Date of Patent: Sep. 12, 1995

[54] CLASSIFYING GRATE

[76] Inventors: Gert Braun, Hofacker Strasse 12a; Ernst Braun, Hofacker Strasse 12b, both of 45259 Essen, Germany

[21] Appl. No.: 231,072

[22] Filed: Apr. 22, 1994

[30] Foreign Application Priority Data

May 28, 1993 [DE] Germany ..... 43 17 830.8

[51] Int. Cl.[6] ..... B07B 1/14

[52] U.S. Cl. ..... 209/675; 209/678

[58] Field of Search ..... 209/673, 669, 667, 668, 209/676, 675, 677, 677, 678

[56] References Cited

U.S. PATENT DOCUMENTS 2,743,813 5/1956 Erickson ..... 209/668
2,852,136 7/1954 Peck ..... 209/677
4,128,282 12/1978 Bost ..... 209/673
4,291,808 9/1981 Roloff ..... 209/668
4,405,050 9/1983 Fenton ..... 209/668
4,627,541 12/1986 Johnson ..... 209/668

*Primary Examiner*—Andres Kashnikow
*Assistant Examiner*—Lisa Douglas
*Attorney, Agent, or Firm*—Herbert Dubno

[57] ABSTRACT

A classifying grate has corrugated bars with respective stubs eccentrically journaled in bearing blocks in bearing chambers of the longitudinal supports on either side of the grate bars. The bearing blocks have play Sr in the feed direction of the breaker product, and the bars can move with axial play relative to the blocks. The play and eccentric mountings of the grate bars ensures that there will be no jamming of the product in the gaps between the bars and consequent damage to the bear stubs and blocks.

20 Claims, 3 Drawing Sheets

CLASSIFYING GRATE

FIELD OF THE INVENTION

The present invention relates to a classifying grate for the preseparation of finely divided products upstream of a breaker, e.g. mineral matter such as rock, the classifying grate having grate bars which are disposed parallel to one another and transverse to a direction of travel of the breaker products across the grate.

BACKGROUND OF THE INVENTION

Classifying grates are known in which the grate bars are formed as eccentric-disk rollers and in which the rollers are arranged eccentrically. With classifying grates of this type in which the grate bars are rotatably entrained or are driven, the grate bars can have a triangular configuration with arcuate sides. Grate bars are also known with concentric ribs which are uniformly spaced apart so that in all positions, uniform free openings can be provided. The drive of the grate bars can be effected by sprocket wheels and drains. In conventional classifying grates the spacing between the bars is fixed or constant and the bars cannot move relative to one another.

One of the characteristics of conventional bar grates of this type is that the breaker product to be separated can jam between the grate bars and in the grate openings. This type of jamming action can give rise to stress at the bearings of the rotational grate bars with resulting damage to the bearings and deformation of the grate bars.

OBJECTS OF THE INVENTION

It is the principal object of the present invention to provide a classification bar grate whereby the aforedescribed drawbacks are avoided.

Another object is this invention is to provide a classifying grate adapted to be located upstream of a breaker for comminuting mineral products to effect a preseparation prior to delivery of the product to the breaker, whereby jamming and damage to the bearings of the grate elements and deformation of the grate bars is avoided.

Still another object of the invention is to provide a classifying grate which enables the gap between bar elements to vary to a limited extent, thereby avoiding excess stresses upon the grate bars and their bearings which can result from jamming of material between them.

SUMMARY OF THE INVENTION

These objects and others which will become apparent hereinafter are attained, in accordance with the invention in a construction of a classifying grate wherein the grate bars are formed as eccentrically journaled corrugated bars and the corrugated bars have respective bearing stubs which are received in respective supports along longitudinal edges of the grate with a predetermined play in respective bearing chambers in the direction of feed of the breaker product over the grate. According to a feature of the invention, the corrugated bars with their bearing stubs also have a limited or predetermined play in the bearing chambers in the direction transverse to the feed direction.

In the classifying grate of the invention, therefore, a floating bearing is provided for each stub with horizontal play in axial and radial directions, but not in the vertical direction, so that the gap between the bars is variable. As material tends to jam between the bars, therefore, the gap can change to prevent such jamming or to allow loosening of material which might tend to jam between the bars, thereby avoiding excess stress upon the corrugated bars and their bearings.

This not only results in the maintenance of the quality and dimensions of the corrugated bars but also improves the quality of the breaker product since the preseparation can be effected more uniformly and completely than has hitherto been the case.

The classifying grate for preseparation of a product to be comminuted and located upstream of a rock breaker, can comprise:

a pair of transversely spaced longitudinal coplanar supports formed with longitudinally spaced journaling chambers opening inwardly;

a multiplicity of corrugated grate bars spanned between the supports and spaced apart therealong; and respective bearing members eccentrically rotatably journaling respective ends of each of the grate bars and received with predetermined play in a longitudinal direction of the respective supports corresponding to a direction of advance of the product over the classifying grate, in respective ones of the chambers.

Each of the ends of the grate bars can have a journaled stub received with predetermined axial play in the chamber transverse to the direction of the advance of the products over the grate.

Each of the bearing members can be a slidable bearing block receiving the respective stub, each stub being slidable axially in the block.

According to another aspect of the invention, the classifying grate can comprise:

a pair of transversely spaced longitudinal coplanar supports formed with longitudinally spaced journaling chambers opening inwardly;

a multiplicity of corrugated grate bars spanned between the supports and spaced apart therealong; and respective bearing members eccentrically rotatably journaling respective ends of each of the grate bars and received with predetermined play transverse to a longitudinal direction of the respective supports corresponding to a direction of advance of the product over the classifying grate, in respective ones of the chambers.

In still another aspect the grate can comprise:

a pair of transversely spaced longitudinal coplanar supports formed with longitudinally spaced journaling chambers opening inwardly;

a multiplicity of corrugated grate bars spanned between the supports and spaced apart therealong;

respective bearing members eccentrically rotatably journaling respective ends of each of the grate bars in respective ones of the chambers; and inwardly open channel-forming guides on each of the supports for ends of flights of an endless flight conveyor chain drawing the product over the classifying grate, the channel-forming guides defining side walls of a flight conveyor.

The bearing blocks can be composed of self lubricating plastic, e.g. polytetrafluroethylene or bronze to facilitate the floating journaling of the corrugated bars.

According to the invention, moreover, the corrugated bars can have an annular cross section and can be composed of alternating annular corrugation crests and troughs or valleys so that optimum passages are provided between the crests.

The supports can have an L-shape or U-shape channel cross section opening inwardly and formed with partitions defining the bearing chambers between them.

By the spacing of the partitions and the bearing chamber width, diameters of the bearing stubs and dimensions of the bearing blocks, the maximum and minimum spacing of the corrugated bars can be established. The minimum distance should be such that the corrugated bars and their crests do not come into contact with one another. This guarantees a damage free journaling of the bars.

As noted, the journaling of the bars should be free from vertical play in the bearing chambers, a vertical excursion being provided however, by the eccentric journaling of the bars. Because the widths of the bearing chambers and diameters of the stubs of the corrugated bars or the widths of the bearing blocks, we are able to select different bar spacings and the openings can also be influenced by different crest spacings along the bars as desired. The size of the particles to be passed by the grate can thus be selected as desired without concern for an increased past particle size because of the variable gap widths. According to another feature of the invention, the supports along the sides of the bars in which the stubs of the bars are eccentrically journaled can be formed with channel side walls of a flight conveyor. The flights of the conveyor can be interconnected by chains to entrain the material to be comminuted across the grate. The invention thus is also a classifying grate for a chain driven flight conveyor. The channel side walls themselves can be provided externally with channel side walls being built into or onto these channels.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
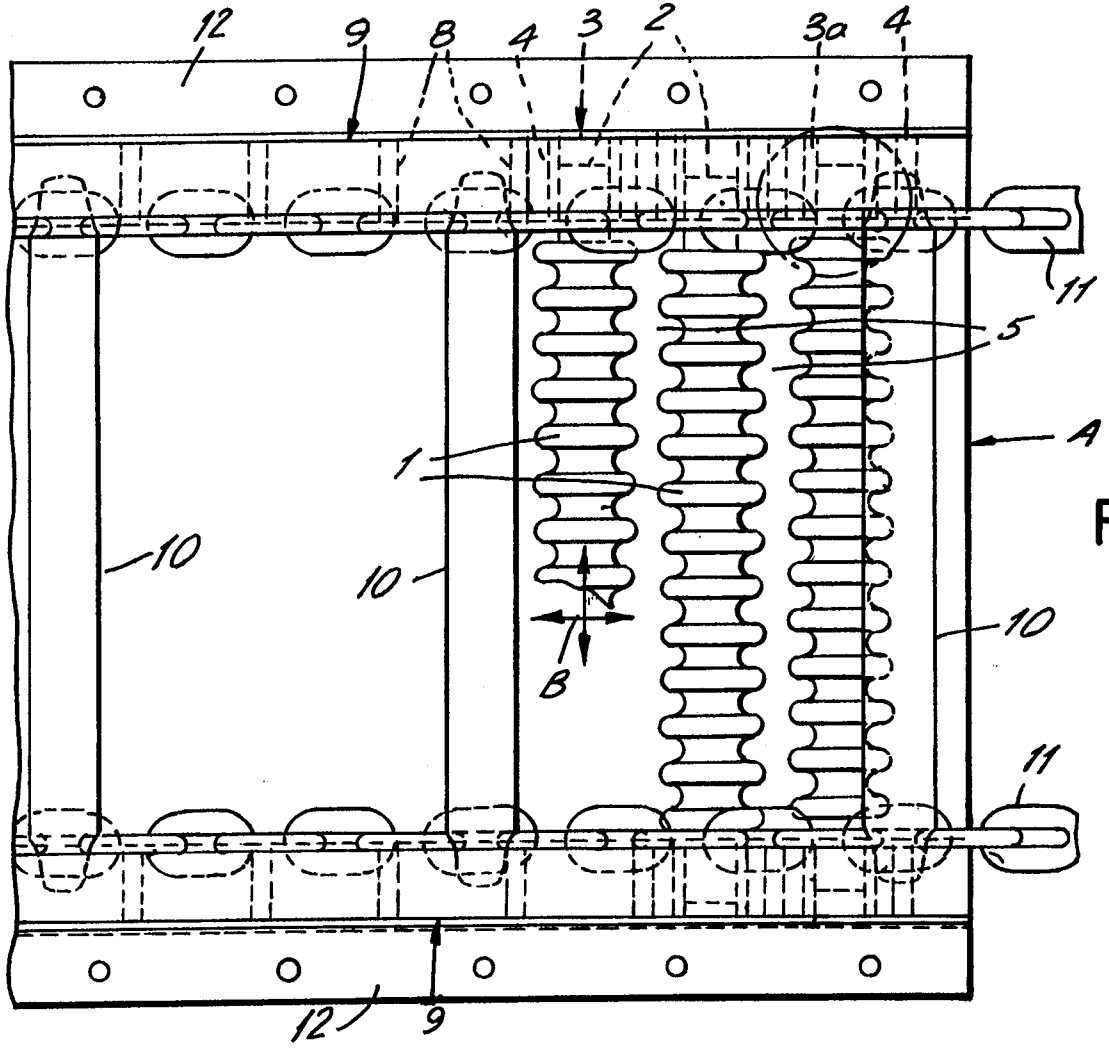
FIG. 1 is a plan view, partly broken away of a classifying grate for a double channel flight conveyor.
Figure 2:
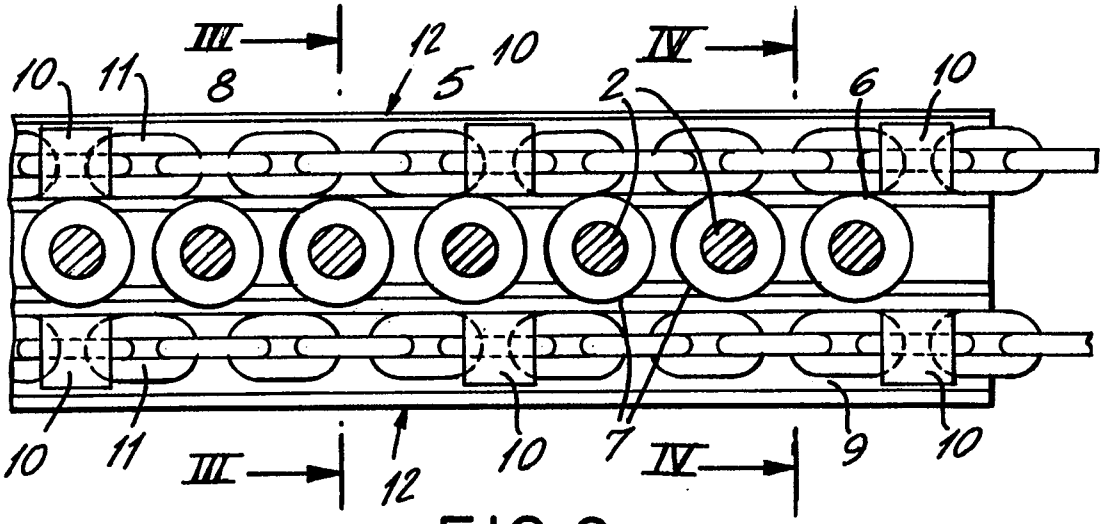
FIG. 2 is a side view of the grate of FIG. 1 with vertically sectioned bearing pins.

In the drawing, we have shown a classifying grate for the preseparation of finely divided mineral matter upstream of a rock breaker, e.g. a hammermill or jaw crusher. This classifying grate comprises a multiplicity of mutually parallel grate bars 1 disposed transversely to a direction of feed (arrow A) of the breaker product. The ends of the grate bars 1 are provided with stubs 2 in supports 3 on which the grate bars are eccentrically journaled. Each grate bar is a corrugated bar with alternating crests 6 and troughs 7 of annular configuration, the crests and troughs being rounded with semicircular rounds.

The bars 1 are mounted by their bearing stubs 2 in respective bearing chambers 4 of the supports 3 extending in the direction of arrow A, with a predetermined play Sr in the feed direction A. In addition, the bars 1 are mounted with play in their axial directions (transverse to the feed direction A), with a play Sa in the respective bearing chambers 4. Thus, each bar has play in the horizontal plane in both the axial and radial directions as represented by the arrows B.

Upon a tendency of the product to jam in the openings or gaps 5 between the bars 1, therefore, the bars can move within the respective plays, to release the material.

Apart from the play in the horizontal plane, a vertical plane Sn is available by virtue of the eccentric journaling of the bars. As a consequence, a variable passage cross section is provided between the bars.

The bars 1 have their respective bearing stubs 2 journaled in slide blocks 3*a* received in the bearing chamber 4 with the play Sr in the direction of displacement. The stubs can be received with the play Sa in the respective blocks.

Figure 3:
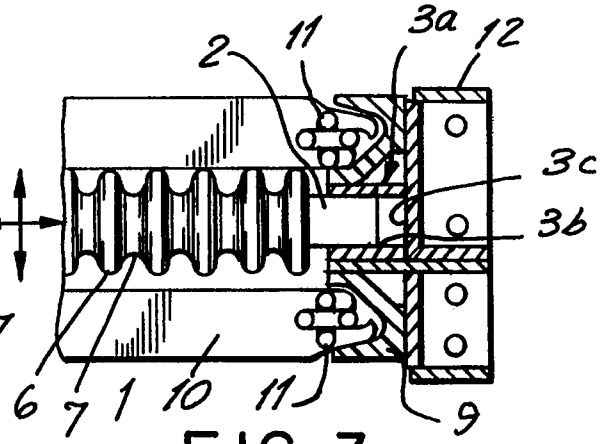
FIG. 3 is a section taken along the line III—III of FIG. 2.
Figure 4:
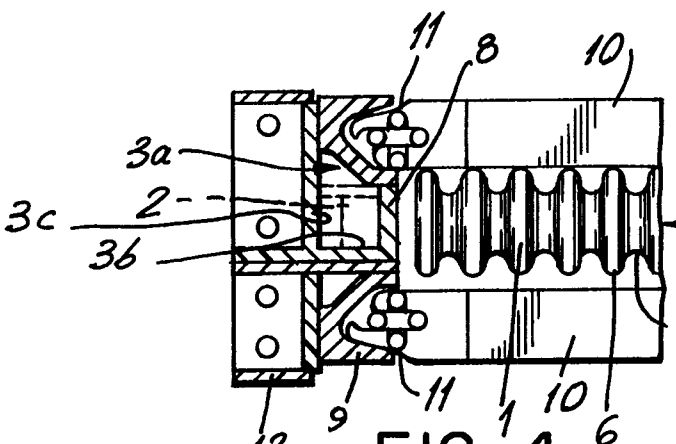
FIG. 4 is a section taken along the line IV—IV of FIG. 2.
Figure 5:
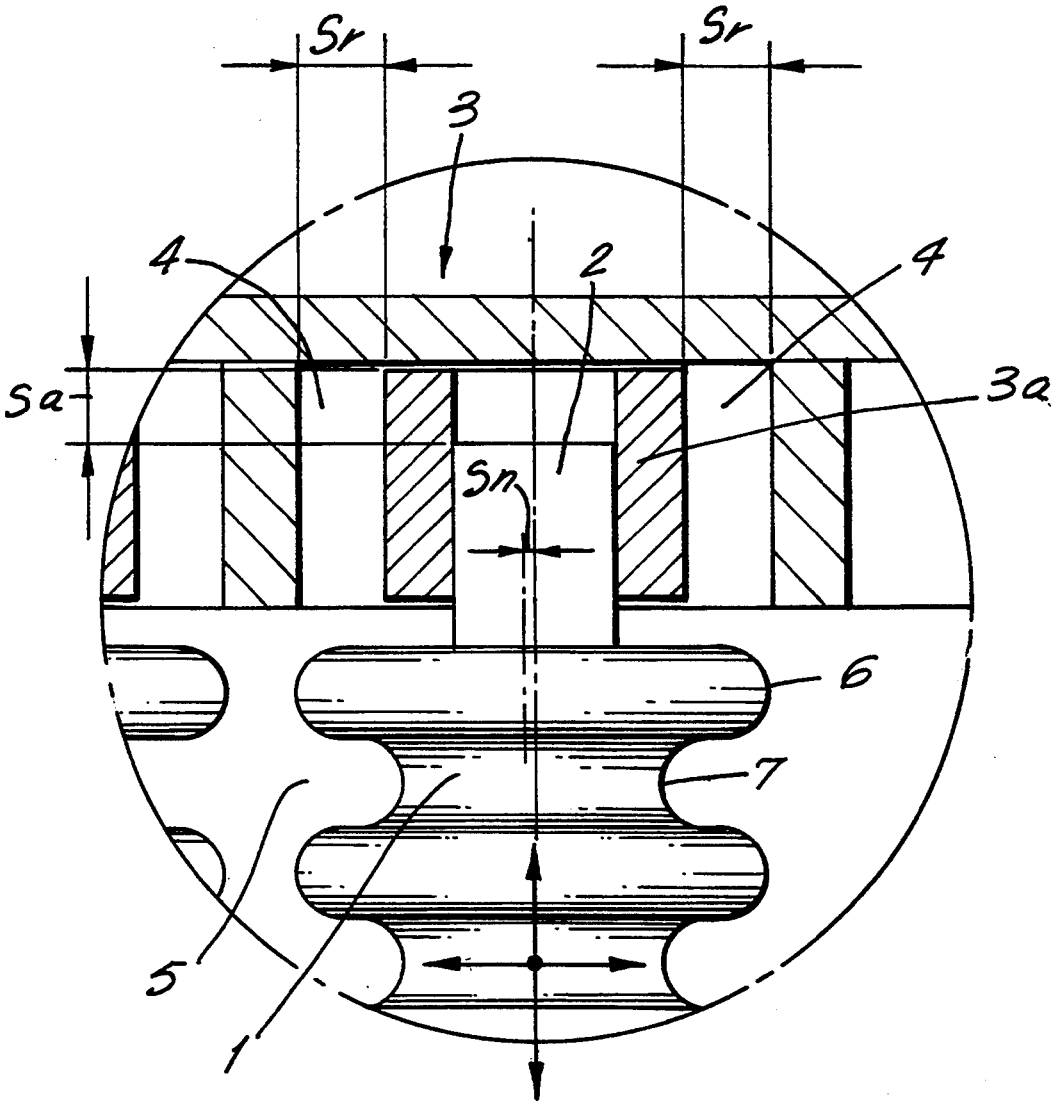
FIG. 5 is a detailed view of the region V of FIG. 1 drawn to a larger scale and partially in section.

The supports 3 are U-section channels opening inwardly and formed by two mutually perpendicular flanges 3*b*, 3*c*. The inwardly turned openings of the channels are subdivided by the partitions 8 to form the individual bearing chambers 4 between them. The horizontal flanges are represented at 3*b* in FIGS. 3 and 4 and the vertical flanges at 3*c* therein. The blocks 3*a* have no vertical play.

As can also be seen from the drawing, above and below each channel 3*a*, channel shaped side walls 9 are provided to open inwardly and accommodate the ends of flight 10 and the channels 11 driving these flights, the side walls 9, flight 10 and channels 11 forming a channel flight conveyor which draws the product to be comminuted over the grate in the arrow A.

Profiles 12 can be built onto or into the side walls 9 and channels 3 (FIGS. 3 and 4) of the double chain flight conveyor.

We claim:

1. A classifying grate for preseparation of a product to be comminuted in a breaker and located upstream of said breaker, said classifying grate comprising:

a pair of transversely spaced longitudinal coplanar supports formed with longitudinally spaced journaling chambers opening inwardly;

a multiplicity of circular-section corrugated grate bars spanned between said supports and spaced apart therealong; and respective bearing members eccentrically rotatably journaling respective ends of each of said grate bars and received with predetermined play in a longitudinal direction of the respective supports corresponding to a direction of advance of said product over said classifying grate, in respective ones of said chambers, said bearing members having gaps between them for linear mobility in said longitudinal direction relative to said supports to define said play.

2. The classifying grate defined in claim 1 wherein each of said ends of said grate bars has a journaled stub received with predetermined axial play in the respective chamber transverse to said direction of advance of said product over said classifying grate.

3. The classifying grate defined in claim 2 wherein each of said bearing members is a slidable bearing block receiving the respective stub, each stub being slidable transversely in the respective block, each block being slidable with said predetermined play in said longitudinal direction in the respective chamber.

4. The classifying grate defined in claim 3 wherein each of said blocks is composed of a selflubricating synthetic resin or bronze.

5. The classifying grate defined in claim 4 wherein each of said blocks is composed of polytetrafluoroethylene.

6. The classifying grate defined in claim 5 wherein each of said grate bars has an annular cross section formed by axially alternating annular corrugation crests and annular corrugation troughs.

7. The classifying grate defined in claim 6 wherein each of said supports is a structural shape having a horizontal flange adjoining a vertical flange and open inwardly, said chambers being delimited by partitions spaced along each support.

8. The classifying grate defined in claim 7 wherein said supports are inwardly open U-section channels.

9. The classifying grate defined in claim 8 wherein said stubs are received in the respective chambers substantially without vertical play.

10. The classifying grate defined in claim 9 wherein each of said supports is formed with an inwardly open channel-forming guides for ends of flights of an endless flight conveyor chain drawing said product over said classifying grate, said channel-forming guides defining side walls of a flight conveyor.

11. The classifying grate defined in claim 10 wherein said side walls are formed externally with reinforcing profiles built onto said side walls.

12. The classifying grate defined in claim 1 wherein each of said bearing members is a slidable bearing block receiving a stub of one of said grate bars, each block being slidable with said predetermined play in said longitudinal direction in the respective chamber.

13. The classifying grate defined in claim 12 wherein each of said blocks is composed of a selflubricating synthetic resin or bronze.

14. The classifying grate defined in claim 1 wherein each of said grate bars has an annular cross section formed by axially alternating annular corrugation crests and annular corrugation troughs.

15. The classifying grate defined in claim 1 wherein each of said supports is a structural shape having a horizontal flange adjoining a vertical flange and open inwardly, said chambers being delimited by partitions spaced along each support.

16. The classifying grate defined in claim 15 wherein said supports are inwardly open U-section channels.

17. The classifying grate defined in claim 12 wherein said stubs are received in the respective chambers substantially without vertical play.

18. The classifying grate defined in claim 1 wherein each of said supports is formed with an inwardly open channel-forming guides for ends of flights of an endless flight conveyor chain drawing said product over said classifying grate, said channel-forming guides defining side walls of a flight conveyor.

19. A classifying grate for preseparation of a product to be comminuted in a breaker and located upstream of said breaker, said classifying grate comprising:

a pair of transversely spaced longitudinal coplanar supports formed with longitudinally spaced journaling chambers opening inwardly;

a multiplicity of corrugated grate bars spanned between said supports and spaced apart therealong; and respective bearing members eccentrically rotatably journaling respective ends of each of said grate bars and received with predetermined play transverse to a longitudinal direction of the respective supports corresponding to a direction of advance of said product over said classifying grate, in respective ones of said chambers.

20. A classifying grate for preseparation of a product to be comminuted in a breaker and located upstream of said breaker, said classifying grate comprising:

a pair of transversely spaced longitudinal coplanar supports formed with longitudinally spaced journaling chambers opening inwardly;

a multiplicity of corrugated grate bars spanned between said supports and spaced apart therealong;

respective bearing members eccentrically rotatably journaling respective ends of each of said grate bars in respective ones of said chambers; and inwardly open channel-forming guides on each of said supports for ends of flights of an endless flight conveyor chain drawing said product over said classifying grate, said channel-forming guides defining side walls of a flight conveyor.

* * * * *